US007160011B2

(12) United States Patent
Wang

(10) Patent No.: US 7,160,011 B2
(45) Date of Patent: Jan. 9, 2007

(54) LIGHT BLOCKING APPARATUS

(75) Inventor: Cheng Wang, Miaoli County (TW)

(73) Assignee: Coretronic Corporation (TW)

( * ) Notice: Subject to any disclaimer, the term of this patent is extended or adjusted under 35 U.S.C. 154(b) by 107 days.

(21) Appl. No.: 11/033,535

(22) Filed: Jan. 12, 2005

(65) Prior Publication Data

US 2006/0077664 A1 Apr. 13, 2006

(30) Foreign Application Priority Data

Oct. 8, 2004 (TW) ..... 93130579 A

(51) Int. Cl.
*F21V 7/00* (2006.01)

(52) U.S. Cl. ..... 362/516; 362/510; 362/539; 362/351; 362/268

(58) Field of Classification Search ..... 362/516, 362/509, 510, 539, 351, 268; 313/113, 117
See application file for complete search history.

(56) References Cited

U.S. PATENT DOCUMENTS 3,553,519 A * 1/1971 Hicks ..... 313/113
3,553,520 A * 1/1971 Hicks ..... 313/113
3,904,904 A * 9/1975 Meinecke et al. ..... 313/113
4,564,783 A * 1/1986 Krieg et al. ..... 313/113
5,213,406 A * 5/1993 Neumann et al. ..... 362/512
5,353,210 A * 10/1994 Strok et al. ..... 362/293

* cited by examiner

*Primary Examiner*—Thomas M. Sember

(57) ABSTRACT

A light blocking apparatus is applied in an illuminating module of a projector. The light blocking apparatus includes a light shield and a support rod securing the light shield. The light shield is positioned in front of a bulb of the illuminating module. The support rod connects the light shield and another apparatus, such as a lamp reflector, so as to position the light shield in front of the bulb. The light shield is employed to block the light reflected from a UV-IR wheel and a color wheel so that the bulb won't be heated again.

8 Claims, 3 Drawing Sheets

LIGHT BLOCKING APPARATUS

RELATED APPLICATIONS

The present application is based on, and claims priority from, Taiwan Application Serial Number 93130579, filed Oct. 8, 2004, the disclosure of which is hereby incorporated by reference herein in its entirety.

BACKGROUND OF THE INVENTION

1. Field of Invention

The invention relates to a cooling assistance apparatus and, in particular, to a light blocking apparatus.

2. Related Art

As shown in FIG. 1, the light source module of a conventional projector uses a light bulb 500, whose light is collected by a reflective lampshade 700, processed by a filter 400 and a color wheel 300, and directed toward an optical engine. The conventional method of cooling a projector bulb 500 is to use a blower 800 to send cooling air toward the reflective lampshade 700. When the cooling air passes by high-temperature points such as the lampwick 510, the soldering point 520, and the terminal 530, it takes away the generated heat and sends the heat outside.

Light collected by the reflective lampshade 700 goes through a filter 400, filtering out the ultraviolet (UV) and infrared (IR) components, and produces red (R), green (G) and blue (B) light in consequence using a color wheel 300. Therefore, part of the light is reflected by the filter 400 and the color wheel 300. The UV, IR, and unpassed light is reflected back to the projector bulb 500. As shown in FIG. 1, the reflected light is collected in the vicinity of the soldering point 520 and the terminal 520. In addition to the heated generated by the soldering point 520 and the terminal 520 themselves, secondary heating is caused by the reflected light, resulting in inhomogeneous cooling of the projector bulb 500.

To solve this problem, the prior art usually increases the rotation speed of the blower or uses a larger blower 800. However, using a larger blower will increase the volume of the blower and increasing the rotation speed of the blower may shorten the lifetime of the blower 800 and produce noises. Such methods may also result in over-cooling on the projector bulb 500 and other parts of the reflective lampshade 700, affecting its performance and lifetime.

SUMMARY OF THE INVENTION

Therefore, an objective of the invention is to provide a light blocking apparatus to block light reflected back to the projector bulb in front of the soldering point and the terminal, preventing them from being heated again and improving the cooling effect.

Another objective of the invention is to provide a light blocking apparatus to improve the cooling effect while affecting the light source brightness as little as possible.

A further objective of the invention is to provide a light blocking apparatus to improve the cooling effect without increasing its volume or the rotation speed of the blower.

To achieve the above objective, the disclosed light blocking apparatus is used in the illuminating module of a projector, containing a light shield and a support rod. The light shield is disposed in front of the bulb of the illuminating module. The support rod connects the light shield and another apparatus, such as a lamp reflector, so as to position the light shield in front of the bulb. The light shield is employed to block the light reflected from a UV-IR wheel and a color wheel so that the bulb is heated again.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE PREFERRED EMBODIMENT

The present invention will be apparent from the following detailed description, which proceeds with reference to the accompanying drawings, wherein the same references relate to the same elements.

Figure 1:
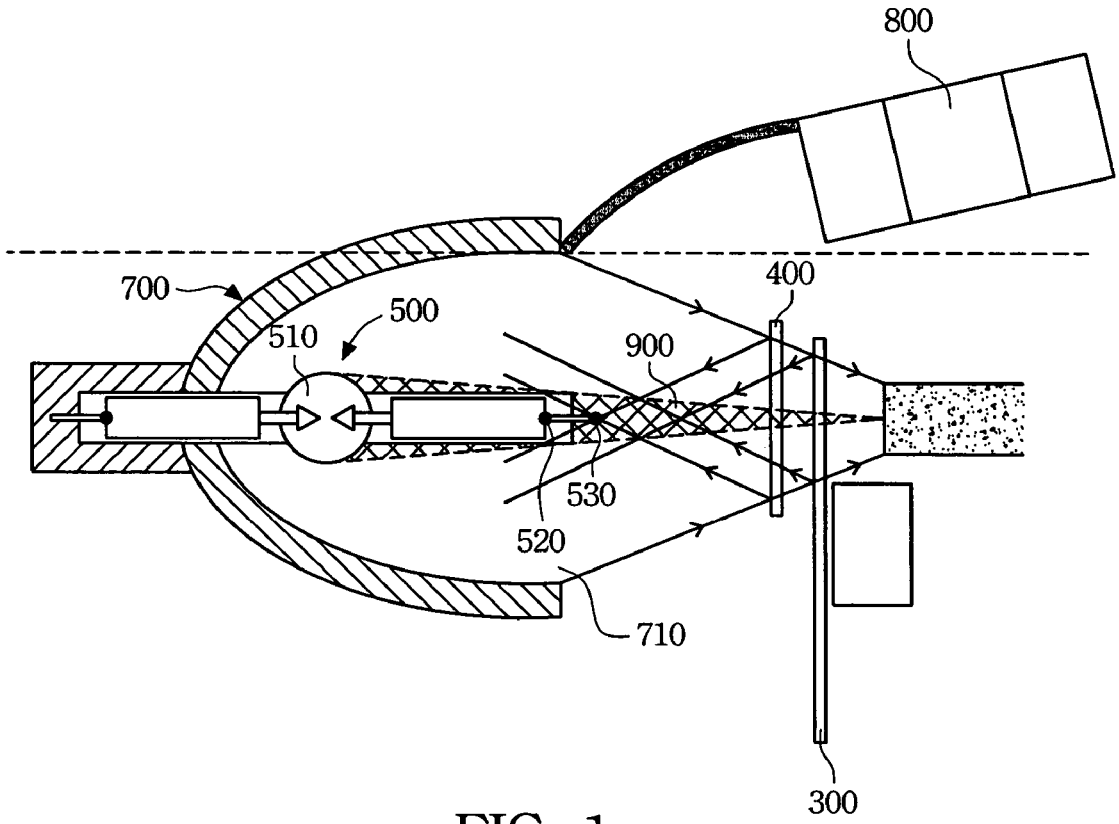
FIG. 1 (PRIOR ART)
FIG. 1 is a schematic top view of the light propagation direction and cooling method in a conventional projector.
Figure 2A:
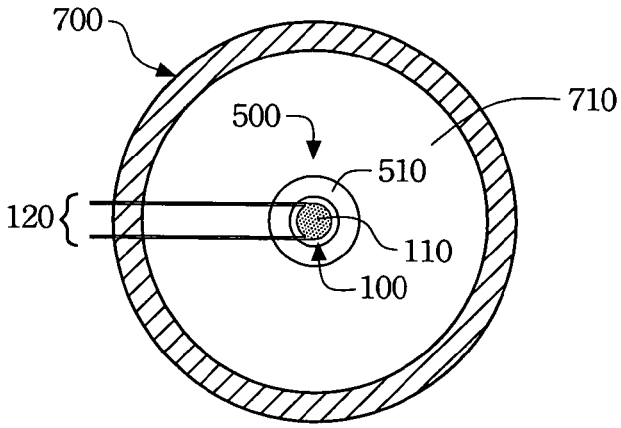
FIG. 2A is a schematic front view of the reflective lampshade of an illuminating module installed with the disclosed light blocking apparatus.
Figure 2B:
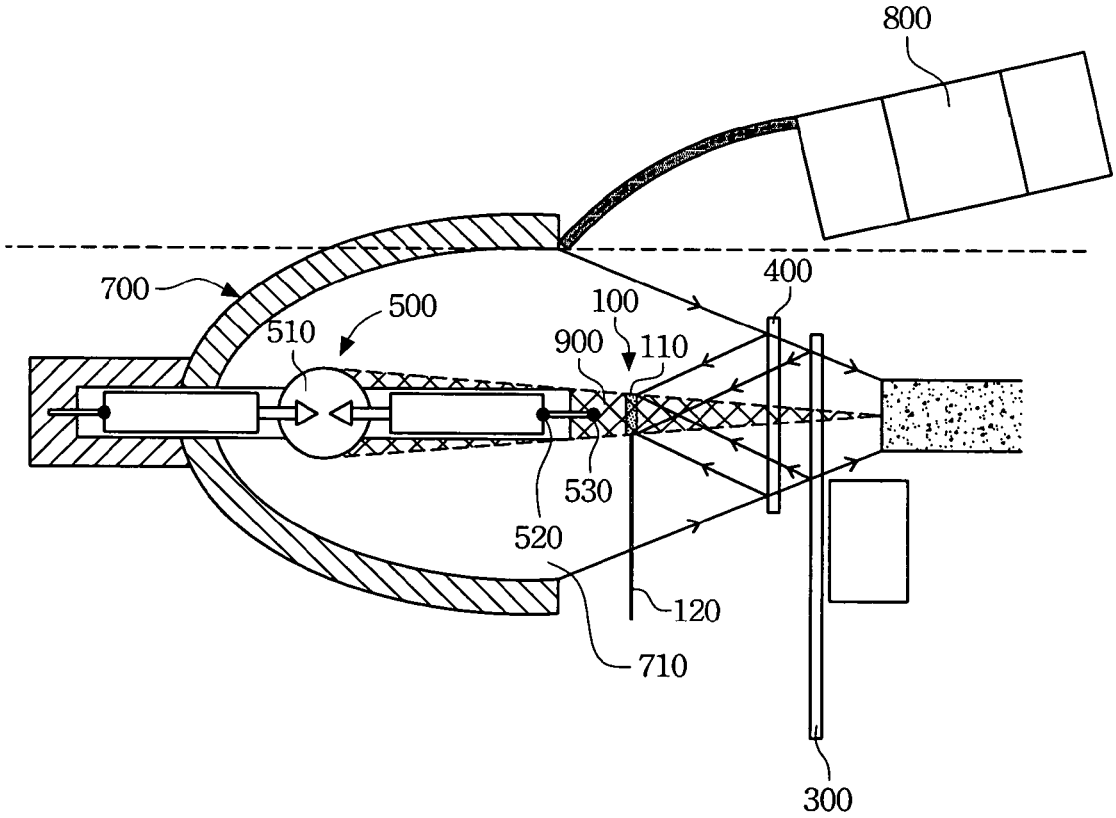
FIG. 2B is a schematic top view of the illuminating module in FIG. 2A.

As shown in FIGS. 2A and 2B, the disclosed light blocking apparatus 100 includes a light shield 110 and a support rod 120. Viewing from the front of the reflective lampshade 700 as in FIG. 2A, the light shield 110 is a circular shield. The central axis of the projector bulb 500 goes through the circular center of the circular shield. The support rod 120 is positioned at an edge of the light shield 110, fixing it in front of the projector bulb 500. As shown in FIG. 2B, the projector bulb 500 is inside the reflective lampshade 700. The axes of the reflective lampshade 700 and the projector bulb 500 coincide with each other, and the reflective lampshade 700 has an opening 710. The center plumb line of the circular light shield 110 coincides with the axis of the projector bulb 500, so that the plane of the light shield 110 is perpendicular to the axis of the projector bulb 500. The rim of the light shield 110 is connected to the interface of an optical axis ineffective region 900. When the light shield 110 falls within optical axis ineffective region 900, the influence of the disclosed light blocking apparatus 100 on the light source brightness is reduced to the minimum, while there is the largest light blocking area in the optical axis ineffective region 900.

As shown in FIG. 2B, light emitted by the lampwick 510 of the projector bulb 500 is reflected and collected by the reflective lampshade 700 to emit via the opening 710 of the reflective lampshade 700. The filter 400 and the color wheel 300 remove some part of the light. The rest light goes through the filter 400 and the color wheel 300 toward an optical engine. When the light goes through the filter 400 and the color wheel 300, some light is reflected by the filter 400 and the color wheel 300 back to the projector bulb 500. However, the installation of the light shield 110 blocks the reflected light in front of the projector bulb 500. The blocking can be achieved by absorbing or reflecting the light. Thus, the light does not continue its propagation to the terminal 530 and the soldering point 520. The terminal 530 and the soldering point 520 are not heated again, rendering a better cooling effect.

Various kinds of changes can be made within the spirit of the invention. For example, the materials of the light shield 110 and the supporting rod can be all kinds of high-temperature resistive substances. They can be made of the same material and formed together, same material and formed separately before connection, or different materials and formed separately before connection.

The light shield 110 can be made of a material that absorbs light. Alternatively, a light reflecting coating or a light absorbing coating can be formed on the light shield 110, on the surface that faces the filter 400 and the color wheel 300 but the projector bulb 500. These methods can all block the light reflected from the filter 400 and the color wheel 400, preventing it from going to the terminal 530 and the soldering point 520 in front of the projector bulb 500.

In the preferred embodiment shown in FIGS. 2A and 2B, the light shield 110 is a circular light shield. In accord with the optical axis ineffective region of the projector bulb 500, it is a circular cone with a circular cross section perpendicular to the axis. The rim of the light shield 110 is connected to the interface of the optical axis ineffective region 900. This is to obtain the largest light blocking area with the least influence on the light source brightness. For the convenience of designs or to increase the light blocking area, the shape of the light shield 110 can be modified as long as the sacrificed light source brightness is taken into account. The light shield 110 can extend outside the optical axis ineffective region to increase the light blocking area. If the light shield 110 is made of a one-way transparent material, light can be emitted from inside the reflective lampshade 700 to outside the light shield. However, the reflected light cannot reach the projector bulb 500 because of the one-way transparent material. If the light blocking area goes beyond the optical axis ineffective region, the influence on the light source brightness can be further reduced.

In the embodiment shown in FIG. 2B, the plane of the light shield 110 is perpendicular to the central axis of the projector bulb 500. However, the invention is not limited to such an example. As long as the above-mentioned light blocking function is achievable, the angle between the light shield 110 plane and the central axis of the projector bulb 500 can be any angle large than 0 degree and smaller than 180 degrees.

Figure 3A:
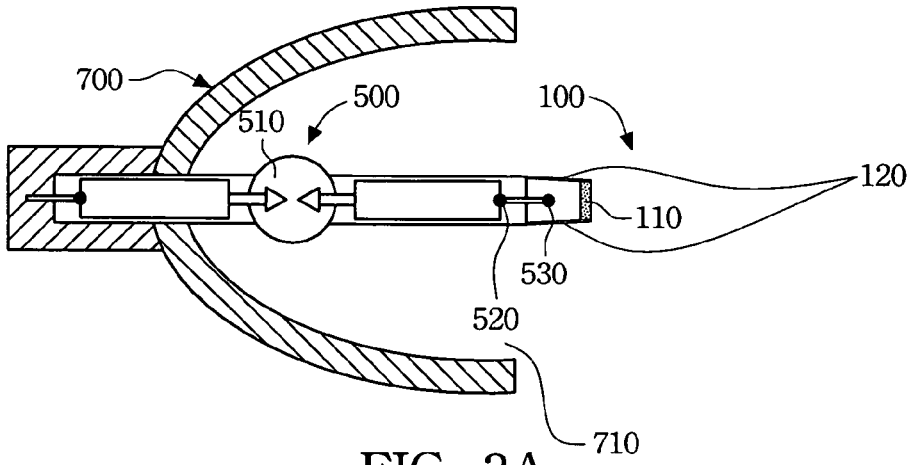
FIG. 3A is a schematic side view of fixing the light blocking apparatus on the projector bulb.
Figure 3B:
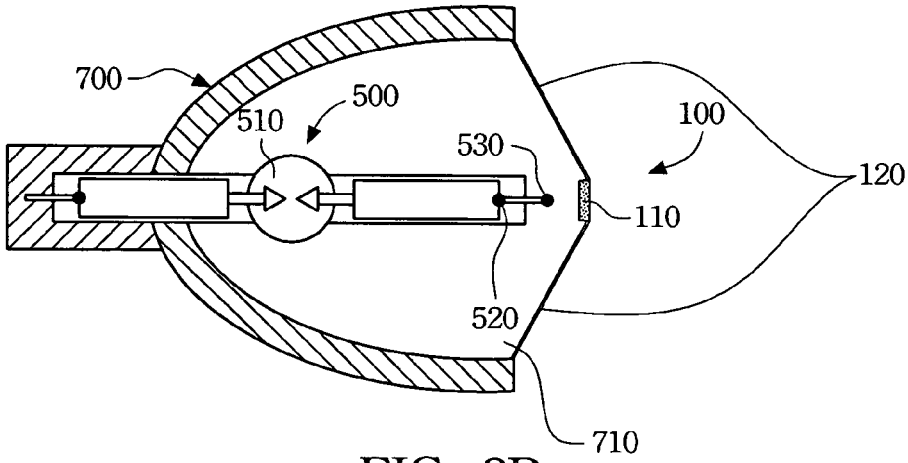
FIG. 3B is a schematic side view of fixing the light blocking apparatus on the reflective lampshade.
Figure 3C:
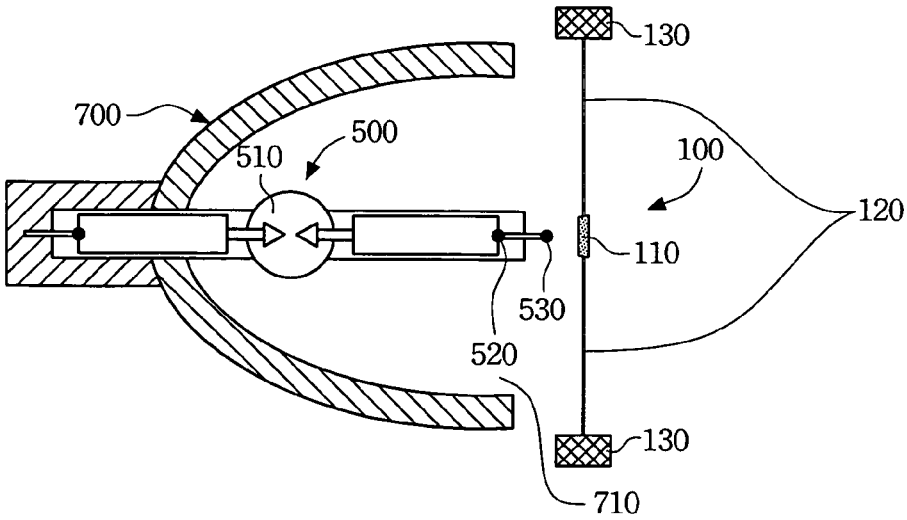
FIG. 3C is a schematic side view of fixing the light blocking apparatus on the fixed base.

The shape of the support rod 110 is not limited to those shown in FIGS. 2A and 2B, either. FIGS. 3A, 3B, and 3C list all kinds of means to fix the light blocking apparatus 100. As shown in the drawings, the disclosed light blocking apparatus 100 can be fixed onto the projector bulb or onto the reflective lampshade 700. Moreover, the disclosed light blocking apparatus 100 can be installed on a fixed base 130 outside the projector bulb 500 and the reflective lampshade 700.

To minimize the influence of the disclosed light blocking apparatus 100 on the light source brightness, the support rod 120 preferably has a thin, long structure. However, it is not limited to such shapes. FIGS. 3A, 3B, and 3C show the disclosed light blocking apparatus from the side of the reflective lampshade. Although they all have two thin, long support rods 120 above and below the light shield 110 to fix the disclosed light blocking apparatus, the support rods 120 are not limited to such positions and their number is not limited to two. As long as the above-mentioned light blocking effect can be achieved, there can be any number of support rods in any shape and disposed at various positions. All such variations should be considered as part of the invention.

One sees from the above preferred embodiment that the invention has the following advantages:

1. Light reflected from the projector bulb is blocked in front of the soldering point and the terminal, preventing them from being heated again and thus rendering a better cooling effect.

2. The light shield is disposed in the optical axis ineffective region. The cooling effect is improved with the least possible influence on the light source brightness.

3. It is not necessary to increase the volume or rotation speed of the blower to achieve the desired cooling effect.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A projector illuminating module comprising:

a reflective lampshade, having an opening;

a projector bulb, disposed inside the reflective lampshade, wherein the light emitted by the projector bulb is collected by the reflective lampshade and projected out via the opening;

a light blocking apparatus, disposed in front of the projector bulb and comprising:

a light shield disposed in front of the projector bulb; and a support rod disposed at the rim of the light shield to fix the light shield in front of the projector bulb;

a filter disposed in front of the light blocking apparatus; and a color wheel disposed in front of the filter, wherein the filter and the color wheel filters the light emitted out from the reflective lampshade toward an optical engine, and the light shield blocks the light reflected by the filter and the color wheel back to the projector bulb.

2. The projector illuminating module of claim 1, wherein the plane of the light shield is perpendicular to the central axis of the projector bulb.

3. The projector illuminating module of claim 1, wherein the light shield is a circular light shield.

4. The projector illuminating module of claim 3, wherein the central axis of the reflective lampshade goes through the center of the circular light shield.

5. The projector illuminating module of claim 1, wherein the light shield is within an optical axis ineffective region.

6. The projector illuminating module of claim 5, wherein the rim of the light shield is connected to the interface of the optical axis ineffective region.

7. The projector illuminating module of claim 1, wherein the light shield is made of a material that absorbs light.

8. The projector illuminating module of claim 1, wherein the projector bulb includes a terminal and soldering point, and the light shield is disposed in front of the terminal and the soldering point to block light reflected from the front of the projector bulb to the terminal and the soldering point.

* * * * *